US006968965B1

(12) United States Patent
Cunningham

(10) Patent No.: US 6,968,965 B1
(45) Date of Patent: Nov. 29, 2005

(54) CONTAINER CLOSURE ASSEMBLY

(76) Inventor: Kelly W. Cunningham, 12158 Lawler St., Los Angeles, CA (US) 90066

( * ) Notice: Subject to any disclaimer, the term of this patent is extended or adjusted under 35 U.S.C. 154(b) by 50 days.

(21) Appl. No.: 10/678,473

(22) Filed: Oct. 3, 2003

(51) Int. Cl.[7] ..... B65D 41/04

(52) U.S. Cl. ..... 215/44; 215/329; 220/288; 53/490

(58) Field of Search ..... 215/43–45, 228, 215/317, 318, 321, 329–331, 341; 220/212, 220/288; 53/490, 488, 485, 468, 317

(56) References Cited

U.S. PATENT DOCUMENTS

| | | | | |
|---|---|---|---|---|
| 1,582,682 A | | 4/1926 | Hammer | |
| 2,312,513 A | * | 3/1943 | Wilson | 215/329 |
| 2,326,809 A | | 8/1943 | White | 215/44 |
| 2,752,060 A | * | 6/1956 | Martin | 215/216 |
| 3,077,280 A | | 2/1963 | Foss et al. | 215/44 |
| 3,323,672 A | | 6/1967 | Acton | 215/44 |
| 3,690,496 A | | 9/1972 | Gibson | 215/9 |
| 3,695,475 A | | 10/1972 | Ruekberg | 215/9 |
| 3,794,200 A | | 2/1974 | Marks | 215/9 |
| 3,923,181 A | | 12/1975 | Libit | 215/224 |
| 3,955,696 A | | 5/1976 | Finke | 215/214 |
| 4,298,129 A | | 11/1981 | Stull | 215/224 |
| 4,561,553 A | | 12/1985 | Crisci | 215/256 |
| 4,712,699 A | * | 12/1987 | Lutz | 215/329 |
| 4,946,055 A | * | 8/1990 | Towns et al. | 215/341 |
| 5,551,582 A | | 9/1996 | Robinson | 215/216 |
| 5,720,402 A | * | 2/1998 | May | 215/321 |
| 5,829,609 A | | 11/1998 | Beck | 215/217 |
| 5,913,437 A | | 6/1999 | Ma | 215/252 |
| 6,105,802 A | | 8/2000 | French et al. | 215/318 |
| 6,702,134 B2 | * | 3/2004 | Scalese et al. | 215/44 |

FOREIGN PATENT DOCUMENTS

DE 101 28 597 * 2/2004

* cited by examiner

*Primary Examiner*—Nathan J. Newhouse
(74) *Attorney, Agent, or Firm*—Kelly W. Cunninham, Esq.; Cislo & Thomas LLP

(57) ABSTRACT

A threaded container closure assembly in which the container comprises one or more radially extending members proximate the distal end thereof that initially engage with one or more radially extending members or partial radially extending members on a mating closure or top proximate the distal end thereof so that the container and top become at least partially interconnected and are thereby not too easily and inadvertently separated while the user attempts to cause engagement of the threads for screwing down the top onto the container.

8 Claims, 4 Drawing Sheets

CONTAINER CLOSURE ASSEMBLY

BACKGROUND OF THE INVENTION

1. Field of the Invention

This invention relates to screw threaded connectors, and more particularly to threaded containers and mating caps, lids, and the like.

2. Description of the Related Art

Screw-type threaded container closures are a well-known method for joining a container to a lid, cap, or other top. Typically, the open end of the container is threaded for receiving a mating threaded closure top. When the top or the container is slippery, one or the other component can slip out of a person's hands. When this happens, the simple task of screwing down a lid is made more difficult and time consuming. If the lid is dropped, it may become soiled or even broken or dented beyond use. If the container is dropped, the whole container may be spilled, broken, or otherwise damaged. Consequently, a person mindful of this concern may take undue time and attention to carefully screw the lid down onto the container.

Also, under many circumstances, the user may prefer to use only one hand to screw the lid down on a container—when the user's hands are otherwise full or the user is preoccupied by other matters, for example. Where the container is fixed or where its weight is sufficient to resist rotating or other movement when it encounters the normal forces exerted on it by the user during the twisting action of screwing down the lid, it may be more convenient and more efficient for the user to screw the lid down simply using one hand, freeing the other hand for other more important matters. Under such circumstances, however, the user may lose the interconnection between lid and container causing the lid to slip off center or slip out of the user's hand, or causing the container to move. Consequently, a person mindful of these annoyances will sometimes use two hands even if this is less convenient and less efficient than simply using one hand.

Additionally, sometimes the threads of a lid are poorly designed or for some other reason not easily engaged with the threads of the container. In these instances, the chances of the user losing his or her grip on either the lid or the container are greatly increased. Also in such instances the operator may find that he or she cannot simply use one hand to screw down the lid at all. In other instances, the user may have a disability of some kind (e.g., arthritis, poor muscle control, poor sight, etc.) and therefore finds it difficult to maneuver a top down onto a container opening with presently available threaded container closure products.

If, however, there was a mechanism that preliminarily connected the container and the lid, the user could attempt to engage the threads without the additional worries of losing his or her grip of the lid or container and may also feel free to screw the lid down with just one hand. Thus, what is needed in a threaded container and mating lid is a mechanism to initially at least partially interlock or interconnect the two so that they are not too easily and inadvertently separated while the user is attempting to cause engagement of the threads for screwing down the lid onto the container.

SUMMARY OF THE INVENTION

The present invention involves a threaded container closure assembly in which the container comprises one or more radially extending members proximate the distal end thereof that engage with one or more radially extending members on a mating closure or top proximate the distal end thereof so that the container and top become at least partially interlocked or interconnected and thereby are not too easily and inadvertently separated while the user attempts to cause engagement of the threads for screwing down the top onto the container.

In one embodiment, the tolerances between container and top are such that only the top or only the container would comprise one or more radially extending members, but not both. In this embodiment, the radially extending members would then engage the surface of the other component to provide a sufficient interconnection to align the components and hold them together to make easier the act of screwing the two components tight. In another embodiment, the interconnection is sufficient for the immediate needs of the user such that the user would not have to attempt to screw down the top onto the container each time to obtain satisfactory closure.

These and other advantages of the present invention will be apparent from a review of the following specification and accompanying drawings.

DESCRIPTION OF THE PREFERRED EMBODIMENT(S)

The detailed description set forth below in connection with the appended drawings is intended as a description of presently preferred embodiments of the invention and is not intended to represent the only forms in which the present invention may be constructed and/or utilized. The description sets forth the functions and the sequence of steps for constructing and operating the invention in connection with the illustrated embodiments. However, it is to be understood that the same or equivalent functions and methods may be accomplished by different embodiments that are also intended to be encompassed within the spirit and scope of the invention.

Figure 1:
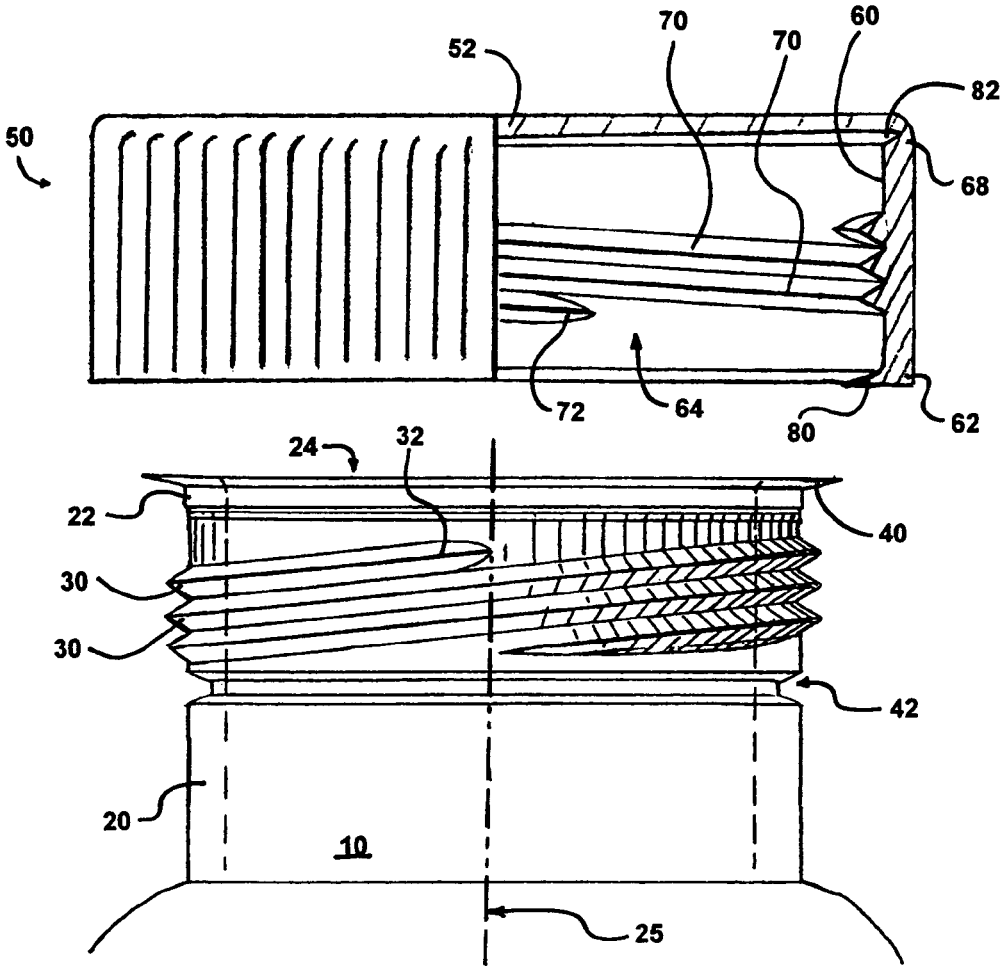
FIG. 1 is an exploded side elevation view of a threaded container opening and top in keeping with one embodiment of the present invention wherein a portion of the top has been removed for illustration purposes.
Figure 2:
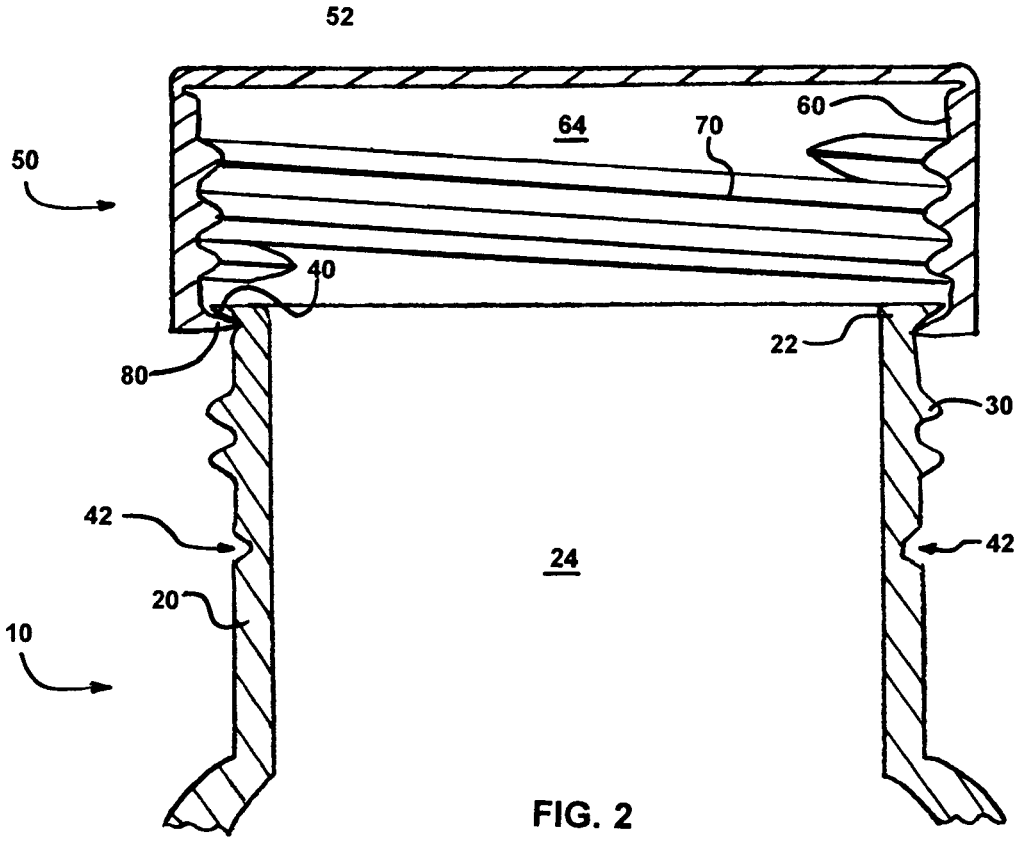
FIG. 2 is an exploded side elevation view of the container and top of FIG. 1 wherein the radially extending members of the top have been pressed just past the radially extending members of the threaded container opening.
Figure 3:
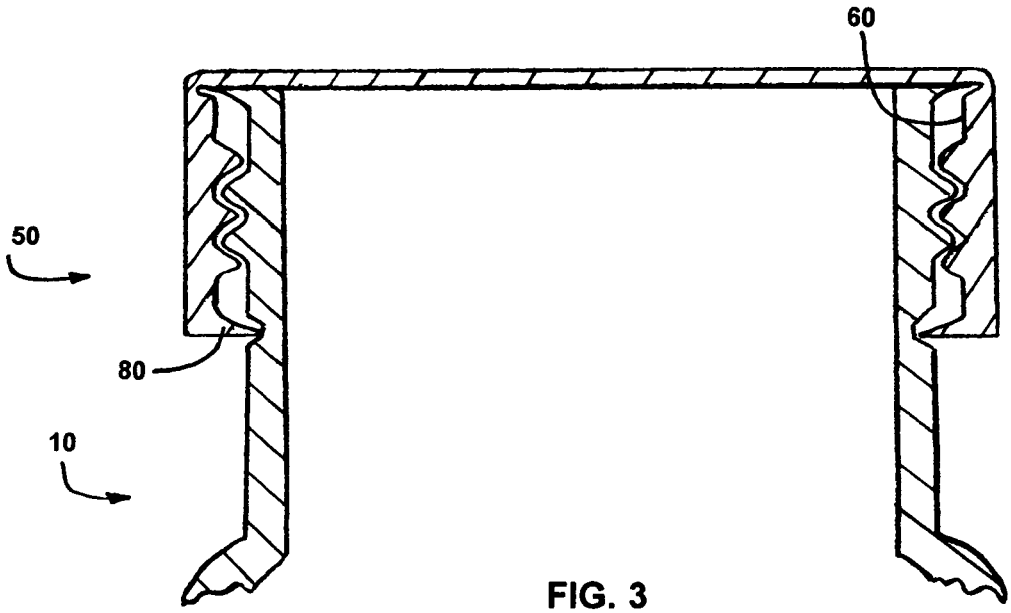
FIG. 3 is an exploded side elevation view of the container and top of FIG. 1 wherein the top has been fully screwed down onto the container.
Figure 4A:
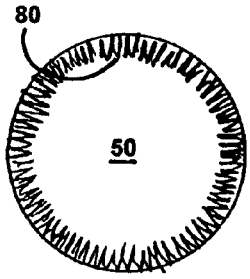
FIGS. 4*a* through 4*e* are a top plan views of container openings in keeping with the present invention illustrating a few different embodiments of the one or more radially extending members formed on a distal end portions of the container openings.
Figure 4B:
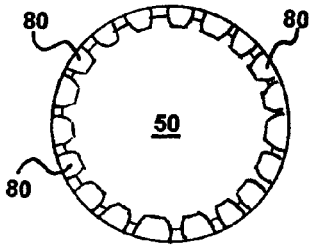
Figure 4C:
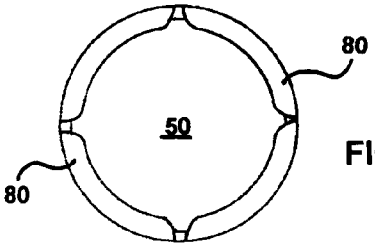
Figure 4D:
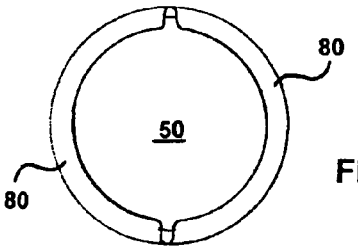
Figure 4E:
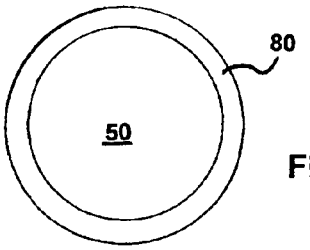
Figure 5A:
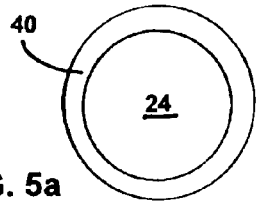
FIG. 5*a* through 5*e* are bottom plan views of closures, lids, caps, or tops in keeping with the present invention illustrating a few different embodiments of the one or more radially extending members formed on a distal end portion of the tops.
Figure 5B:
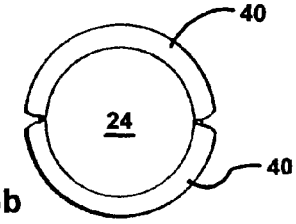
Figure 5C:
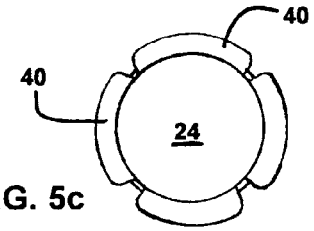
Figure 5D:
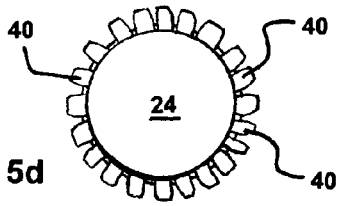
Figure 5E:
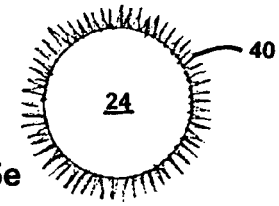

FIGS. 1 through 3 illustrate one embodiment of the present invention, in which there is a container 10 comprising at one end a generally annular sidewall 20 having a distal end 22 that defines an opening 24 having centerline 25. The container 10 further comprises screw-type threads 30 formed near the distal end 22, and one or more radially extending members 40 disposed at the threads 30 or between the threads 30 and the distal end 22. In one embodiment of the present invention, the radially extending members 40 are configured to extend away from the centerline 25 roughly the same distance as the radial extent of threads 30. In another embodiment of the present invention, the radially extending members 40 are configured to extend further away from the centerline 25 than the radial extent of threads 30.

A mating top 50 comprises a base 52 and a central recess defined by a generally annular inner wall 60. The inner wall 60 distends from the base 52 to a distal end 62. Screw-type threads 70 are formed on the inner wall 60 configured to engage the screw-type threads 30 of the container 10. The inner wall also comprises one or more radially extending members 80 disposed proximate the distal end 62 of the inner wall 60.

When a user wants to tighten a top 50 onto a mating container 10 in keeping with the present invention, a user places the top 50 on the container 10 such that distal end 62 of the top is near or touching the distal end 22 of the container and the top 50 is roughly centered and concentric about the centerline 25 of the opening 24. Then, the user presses the top down onto the container using a slight amount of force so that some or all of the one or more radially extending members 80 of the top 50 move past some or all of the one or more radially extending members 40 of the container 10. The top 50 and the container 10 are thereby partially and preliminarily interlocked or interconnected in such a way that the top and the container are not too readily and inadvertently dissociated from one another. Another beneficial result of this preliminary interconnection is that the top 50 and container 10 are aligned and properly positioned for the next step of screwing the top 50 down onto the container 10.

That is, at this point, the top 50 is interlocked or interconnected only preliminarily to the container 10. There are two immediate benefits of this preliminary connection. First, the connection is sufficient to assist the user when the user attempts to align the top with the container and to engage the threads 30 of the container with the mating threads 70 of the top. Second, the connection may, in many instances, be a sufficient connection for the desired purpose at the desired. These two benefits are discussed in turn.

First, as a result of the preliminary interconnection between container and top afforded by the fact that some or all of radially extending members 80 have been pressed past some or all of radially extending members 40, the user can work to engage the threads 30 of the container 10 with the threads 70 of the top 50 with the added assurance that, until the threads are engaged, the container 10 and top 50 are not likely to become inadvertently separated. In some embodiments, the interaction between the radially extending members of one component (for example, the top 50) and the radially extending members or the surface of the annular side wall of the other component help to center the top 50 over the container opening 24 and align the top 50 along the centerline 25 of the opening 24. Consequently, the user can more reliably attempt to engage the threads 30 of the container 10 and the threads 70 of top 50 with less effort and less concern that the two components will be inadvertently separated or that the threads 70 of the top 50 will fail to properly engage the threads 30 of the container 10 through misalignment.

FIGS. 4*a* through 7 illustrate a number of radially extending members 40 and 80 in keeping with the present invention. The illustrated configurations do not constitute an exhaustive or exclusive list of the contemplated possible configurations, but are instead provided as a few examples of radially extending members 40 and 80 for discussion purposes only. The inventor equally contemplates other configurations. FIGS. 4*e* and 5*a* illustrate simple flange configurations in which the single radially extending member 80 of the top 50 extends in the radially inward direction and the single radially extending member 40 of the container 10 extends radially outward. This may, of course, be reversed in closure assemblies in which the threads of the container are formed on the inside surface of the container 10 and the top 50 is configured like a plug to fit partially within the annular sidewall 20 of the container 10 (not shown).

The remaining examples of FIGS. 4*a* through 5*e* illustrate containers and tops that have more than one radially extending members 40 and 80, respectively. The gaps between the plurality of radially extending members can be beneficial in that they can allow the threads of the other component to pass by the radially extending members without deforming the radially extending members as much as in closure assemblies having a single continuous flange-like radially extending member. Additionally, where there are a plurality of radially extending members 40 and 80, as for example in FIGS. 4*a* and *b* and 5*d* and *e*, the radially extending members are generally more flexible and therefore create a different effect on the radially extending members of the other mating component and thereby a different interconnection strength between container and top.

Figure 6:
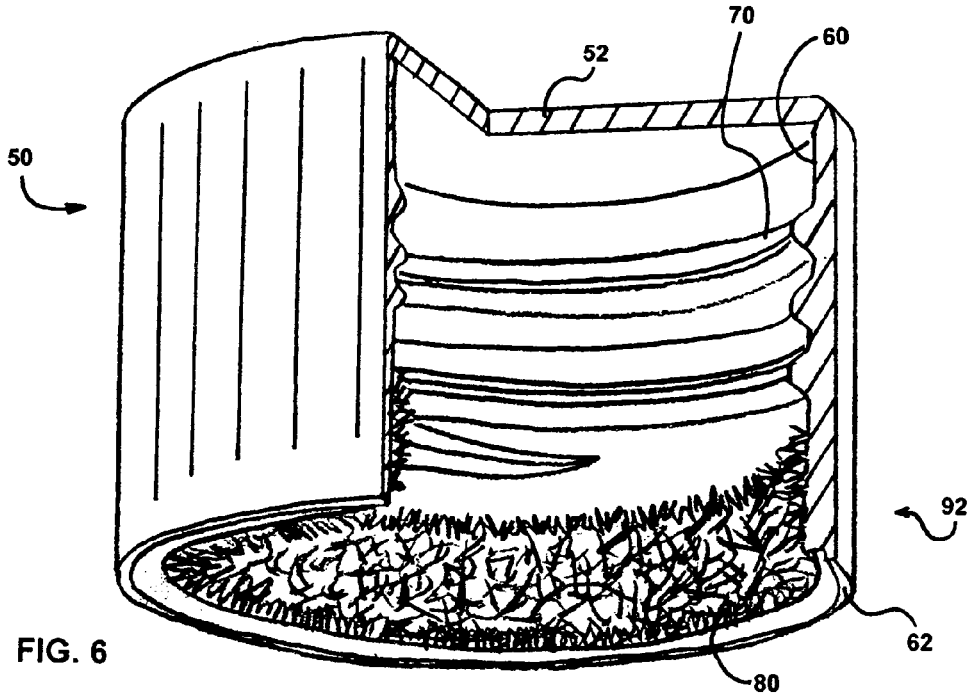
FIG. 6 is a perspective view of a top having another type of radially extending members in keeping with one embodiment of the present invention.
Figure 7:
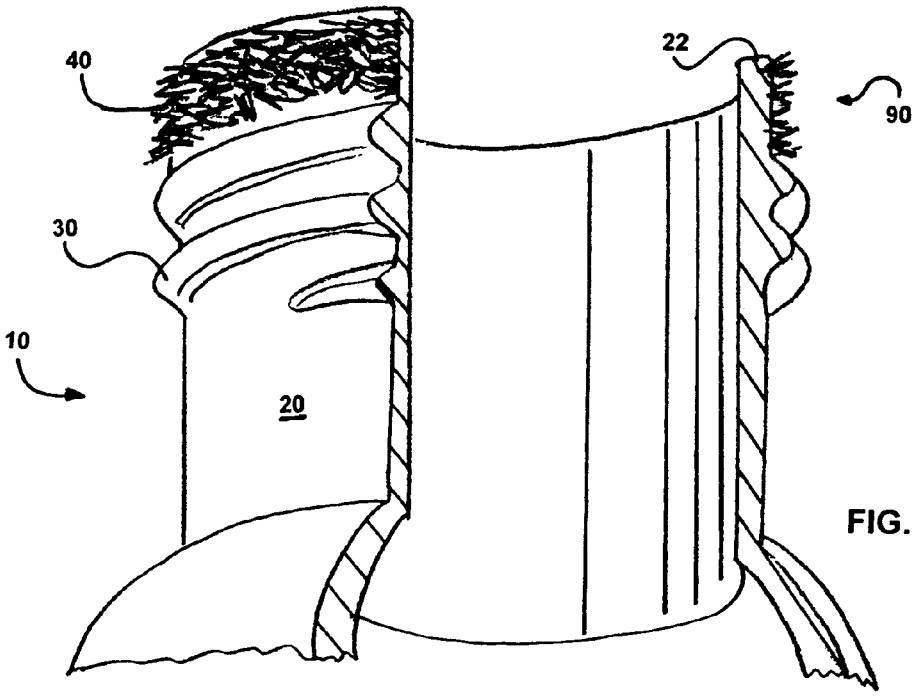
FIG. 7 is perspective view of a container opening having another type of radially extending members in keeping with one embodiment of the present invention.

FIGS. 6 and 7 illustrate other embodiments in which there is more than one row of radially extending members near the distal end of the container or top creating active regions of interconnection 90 and 92, respectively. Both of the components may have multiple rows of radially extending members as shown in FIGS. 6 and 7, or one or the other component may have only a single row of radially extending members as shown in FIGS. 4*a* through 5*e*. In either case, the active region of interconnection in one or both of the components can further assist the user in properly orienting and aligning the top about the centerline 25 of the opening 24, as well as hold the top 50 onto the distal end 22 of the container 10 so that the top and container are not too easily inadvertently separated while the user attempts to engage the threads 30 of the container 10 with the threads 70 of the top 50.

The radially extending members 40 and 80 could therefore take the form of any number of appendages, including flanges, discrete flange segments, short filaments, rods, spars, lugs, hoops, loops, hook members, latch members, or the like. The radially extending members could also take the form of a texture or slight roughness on the surface of the sidewall or inner wall or one or more points where the surface of the sidewall or inner wall itself flares out slightly. It is contemplated that the radially extending members could be made of any resilient material, including the same material as the container or top upon which they are formed or affixed, but also including any other suitable material, such as a soft or hard elastomer, polymeric materials, metal, wood, coarse fibers, and the like.

With respect to this first benefit of the present invention, it should be understood that the radially extending members

40 and 80 could be placed at any point near the distal ends 22 and 62 of the container 10 and of the top 50, respectively. Certain plastic extrusion processes, plastic mold finishing methods, and press sintering techniques, for example, may benefit particularly from forming the radially extending members at or very near the distal ends because this may, among other things, require fewer changes to existing molds, less revamping or retrofitting of existing finishing techniques, and the like. This placement may also make the benefits of the present invention more evident to the consumer or make it less difficult to market or advertise to the consumer the advantages of the present invention.

On the other hand, however, placement of the radially extending members 40 and 80 very near, at, or even just past the beginnings (i.e., the distal-most portions) of the threads 30 of the container 10 and/or the threads 70 of the top 50 could make the next step of engaging the threads of the container and top much simpler or even automatic for the user. That is, when the beginning threads 32 of the container 10 are proximate to the radially extending members 40 of the container 10, once the user presses the radially extending members 80 of the top 50 past the radially extending members 40 of the container 10, the user will not have to apply any further axial force in order to get the beginning threads 72 of the top 50 to engage the beginning threads 32 of the container 10. The user therefore is offered a simple two-step closure method: press and twist.

If in fact the beginning threads 32 of the container 10 are immediately proximate or even extend just beyond the radially extending members 40 of the container 10, this positioning can cause the top 50 to instantaneously rotate into place at the moment the user presses of snaps the radially extending members 80 of the top 50 past the radially extending members 40 of the container 10 (i.e., when the beginning threads 72 of the top 50 are also somewhat close to the radially extending members 80 of the top 50). This action would thereby initiate the screwing down of the top 50 onto the container 10, offering the user a virtually one-step closure method and greatly simplifying the application of the top to the container for the user.

Moreover, where the tolerances between the container and the top are particularly small, the radially extending members of the top or of the container can act directly upon the mating surface of the other mating component without the need for radially extending members on the other component. In such embodiments, the contact between the radially extending members and this mating surface of the other component itself will have the previously discussed effect of causing the container and the top to be preliminarily interlocked or interconnected and aligned so that inadvertent separation of the two is avoided while the user attempt to engage the threads and screw down the top onto the container.

Secondarily, the preliminary connection between container and top created by the interaction between the respective radially extending members 40 and 80 may be a sufficient connection for many circumstances. A user may not want or need to completely screw down a top onto a tube of toothpaste, for example, each morning. In such circumstances, the radially extending members 40 and/or 80 can act as a simple snap closure alternative to the more secure closure available through engaging the screw-type threads 30 and 70. In some embodiments, the simpler snap alternative can in fact act as a Velcro™-like hook-and-loop closure for the container industry, such as the embodiments illustrated in FIGS. 6 and 7, under those numerous circumstances where such a temporary connection would be perfectly acceptable—or at least perfectly acceptable some of the time.

In one embodiment of the present invention, the container has one or more annular recesses 42 for receiving the radially extending members 80 of the top 50 when the top 50 is fully screwed down onto the container 10. Similarly, top 50 may have one or more annular recesses 82 for receiving the radially extending members 40 of the container 10. In this embodiment, therefore, the shape of the radially extending members 40 and 80 of the container and top, respectively, may be preserved and not deformed during long periods in which the top is fully screwed down onto the container, although it is not necessarily the case that the radially extending members 40 and 80 would otherwise become deformed during long period in which the top 50 and container 10 are screwed tight. Some of the configurations of the radially extending members 40 and 80 illustrated herein or otherwise within the intended scope of the present invention understandably resist becoming deformed under such circumstances, such as when the radially extending members are made of an elastomeric material or some other sufficiently flexible and resilient material, or when the radially extending members are spaced apart or notched so as to avoid the threads and surface wall of the mating component. In other such configurations and ambient conditions, the radially extending members 40 and 80 could benefit from the added protection from becoming deformed by, for example, providing recesses 82 and 42, respectively.

The foregoing discussion of the present invention utilized a threaded container 10 and mating lid or top 50 for illustration purposes only. Yet other assemblies are equally contemplated in the present invention. Plumbing applications, hoses, pipes, and tubes, for example, can all benefit from the innovative aspects of the present invention. Each of these applications can advantageously employ paired radially extending members 40 and 80 on their threaded male and female components to afford an intermediate preliminary interconnection between the components that assists the user in aligning the components and holding them together while the user attempts to engage the threaded features of the components for screwing the two components tight.

Similarly this innovative aspect of the present invention provides the described advantages to other components that are designed to be screwed down to a threaded post, such as commercial electronic components, cameras and tripods, threaded mounts and handles, nuts and bolts, and the like. In each instance, the male threaded component comprises at its threaded end one or more radially extending members, and the tapped female component comprises at or near its distal end one or more inwardly directed radially extending members. The user places the male and female components against one another and presses the female component over the male component such that the radially extending members of the female component press past the radially extending members of the male component. As a result, the male and female components are better aligned and are held together thereby assisting the user while the user attempts to initiate screwing the threads of the female component down onto the male component. Also, in many such applications, the preliminary interconnection may work perfectly well to provide a sufficient connection between male and female components at least some of the time without the user having to resort to tightly screwing the two components to each other.

While the present invention has been described with regards to particular embodiments, it is recognized that additional variations of the present invention may be devised without departing from the inventive concept.

What is claimed is:

1. A method for preliminarily connecting and thereafter tightening a top onto a container comprising:

placing a distal end of a top near a distal end of a container, pressing one or more radially extending members on the top past one or more radially extending members on the container, thereby preliminarily connecting the top to the container sufficiently to align the top with the container and to reduce the chance that the top and the container will become inadvertently separated, thereafter tightening the top down onto the container wherein said one or more radially extending members on the top are formed or affixed proximate the distal end of the top between the distal end of the top and threads formed on the top, and wherein said one or more radially extending members on the container are formed or affixed proximate the distal end of the container between the distal end of the container and threads formed on the container.

2. A method according to claim 1 wherein the step of securely tightening a top onto a container comprises engaging threads formed on the container with threads formed on the top, and thereby screwing the top down onto the container.

3. A method according to claim 2 wherein said one or more radially extending members on the top are formed or affixed proximate the threads formed on the top.

4. A method according to claim 2 wherein said one or more radially extending members on the container are formed or affixed proximate the threads formed on the container.

5. A method for temporarily connecting or alternatively securely tightening a top onto a container comprising:

placing a distal end of the top near a distal end of a container, pressing one or more radially extending members on the top past one or more radially extending members on the container, thereby temporarily connecting the top to the container sufficiently to resist the chance that the top and the container will become inadvertently separated, and thereafter alternatively securely tightening the top down onto the container, wherein said one or more radially extending members on the top are formed or affixed proximate the distal end of the top between the distal end of the top and threads formed on the top, and wherein said one or more radially extending members on the container are formed or affixed proximate the distal end of the container between the distal end of the container and threads formed on the container.

6. A method according to claim 5 wherein the step of securely tightening a top onto a container comprises engaging threads formed on the container with threads formed on the top, and thereby screwing the top down onto the container.

7. A method according to claim 6 wherein said one or more radially extending members on the top are formed or affixed proximate one end of the threads formed on the top.

8. A method according to claim 6 wherein said one or more radially extending members on the container are formed or affixed proximate one end of the threads formed on the container.

* * * * *